US010458760B1

(12) United States Patent
Liu

(10) Patent No.: US 10,458,760 B1
(45) Date of Patent: Oct. 29, 2019

(54) STEP AUTO CLAY THROWER

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 16/253,359

(22) Filed: Jan. 22, 2019

(51) Int. Cl.
*F41J 9/18* (2006.01)
*F41J 9/22* (2006.01)
*F41J 9/24* (2006.01)
*F41J 9/20* (2006.01)

(52) U.S. Cl.
CPC . *F41J 9/22* (2013.01); *F41J 9/18* (2013.01); *F41J 9/20* (2013.01); *F41J 9/24* (2013.01)

(58) Field of Classification Search
CPC .. F41J 9/18; F41J 9/20; F41J 9/24; F41J 9/30
See application file for complete search history.

(56) References Cited

U.S. PATENT DOCUMENTS 2,193,266 A * 3/1940 Betts ..... F41J 9/20 124/8
6,062,207 A * 5/2000 Underhill ..... F41J 9/20 124/8
7,263,986 B2 * 9/2007 Lovell ..... F41J 9/24 124/9
10,088,282 B2 * 10/2018 Laporte ..... F41J 9/22
2017/0052003 A1 * 2/2017 Liu ..... F41J 9/18

* cited by examiner

*Primary Examiner* — John A Ricci
(74) *Attorney, Agent, or Firm* — Jackson IPG PLLC; Demian K. Jackson

(57) ABSTRACT

A step auto clay thrower consisting of a base, a stepping rod, a support, a throwing arm holder, a throwing arm and a mini motor is disclosed. When the stepping rod is depressed, the throwing arm is forced by a second spring to move a link and a first linking member in turning a shaft and a throwing arm forward for causing generation of a centrifugal force to throw a clay away from the throwing arm, and then a motor shaft of the mini motor is driven to rotate the shaft, thereby returning the throwing arm without any manual operation. In the time the throwing arm throws the clay and the throwing arm is returned by the mini motor, the mini motor does not need to overcome the force of the second spring so that the capacity of the mini motor can be minimized.

7 Claims, 12 Drawing Sheets

STEP AUTO CLAY THROWER

BACKGROUND AND SUMMARY OF THE INVENTION

The present invention relates to clay shooting supplies and more specifically, to a step auto clay thrower, which uses a mini motor to automatically return the throwing arm after the throwing arm throws the clay.

U.S. Pat. No. 6,062,207 discloses a clay target launcher designed to be operated by a single person during target practice, which includes a base with a rotatable launching arm mounted thereon, which accommodates a clay target, a trigger to latch the arm in a cocked position and movable to release the arm, a foot pedal, a spring mounted between the foot pedal and the throwing arm to apply rotational bias to the arm, and a trigger release actuator attached between the foot pedal and the trigger.

This prior art design still has drawbacks as follows:

1. After the throwing arm throws the clay target, the user needs to manually return the throwing arm, enabling the trigger catch to be stopped by the trigger arm.

2. It needs to manually load a clay onto the throwing arm after each throwing operation.

Therefore, the aforementioned U.S. Pat. No. 6,062,207 has the problem of operational trouble and inconvenience and needs to be improved.

Further, US 2017/0052003 discloses a non-pedal type clay thrower, which discloses the use of a motor to turn the throwing arm. However, in this configuration, since the motor has to overcome the force of the spring, it is necessary to use a large-sized motor and a complicated transmission gear set to transmit the throwing arm.

The present invention has been accomplished under the circumstances in view. It is therefore the main object of the present invention to provide a step auto clay thrower, which is easy to operate, and which uses a mini motor to directly return the throwing arm after the throwing arm throws the clay.

It is another object of the present invention to provide a step auto clay thrower, which enables the lowest storage clay to fall to the throwing arm automatically for throwing when the throwing arm is returned by the mini motor, facilitating the operation and eliminating the procedure of manually loading the clay.

It is still object of the present invention to provide a step auto clay thrower, which is so configured that when the throwing arm is driven to return to its original position by the mini motor after the throwing arm throwed the clay, the rotation of the mini motor does not need to bear the force of the second spring, so that the use of a small size of mini motor is sufficient for returning the throwing arm.

DETAILED DESCRIPTION OF THE INVENTION

Figure 1:
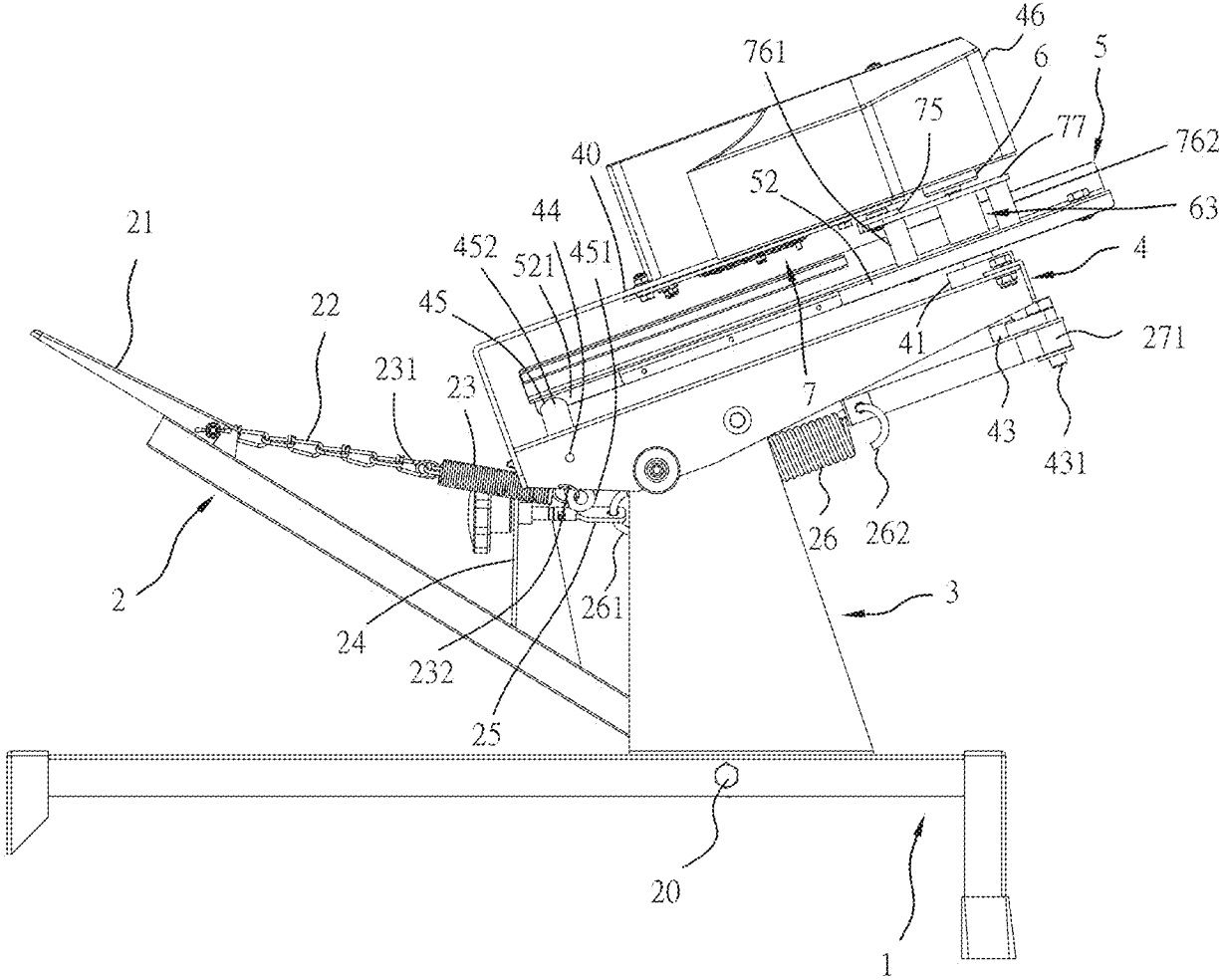
FIG. 1 is a side assembly view of a step auto clay thrower in accordance with the present invention (the clay not shown)/
Figure 2:
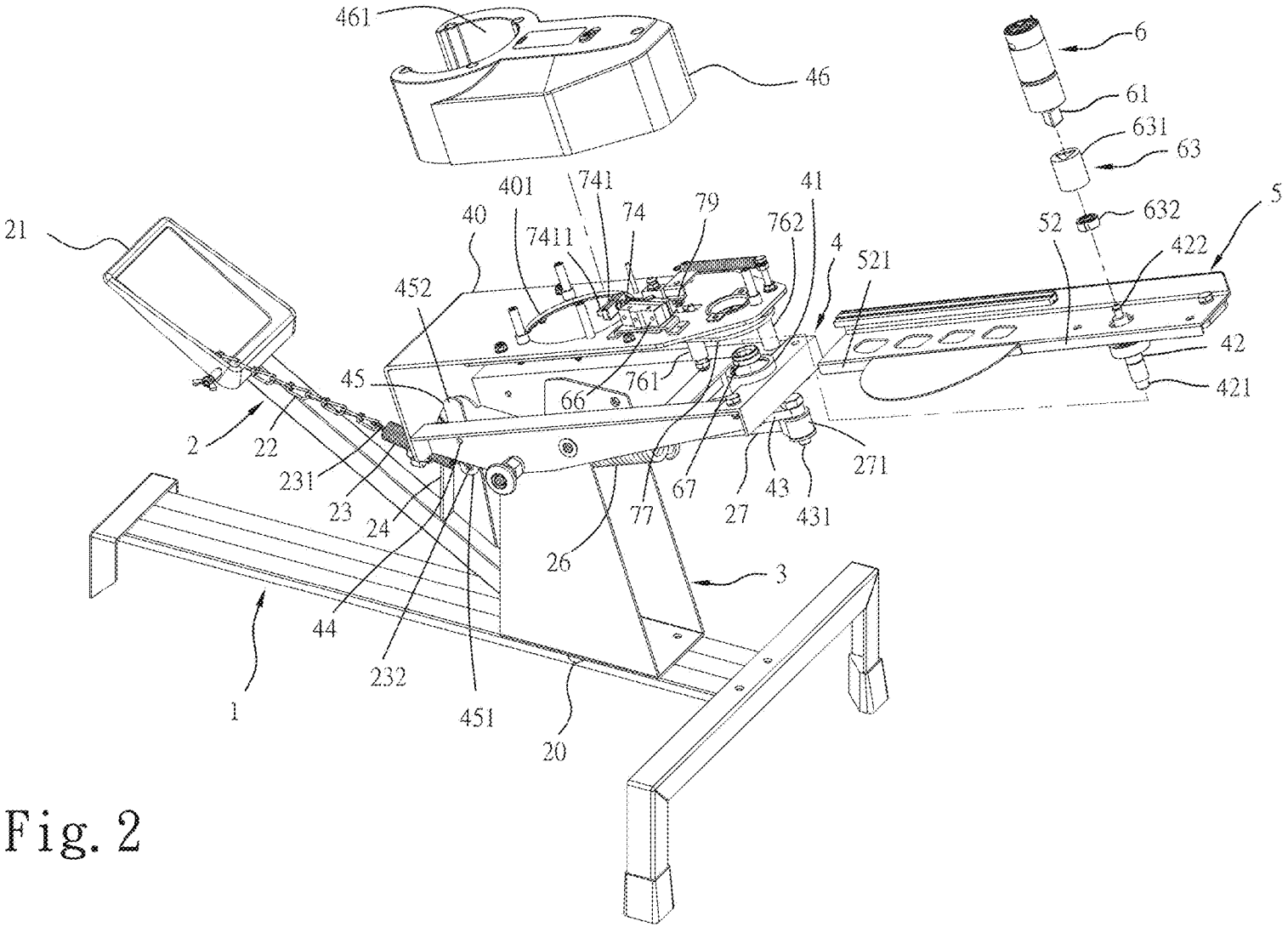
FIG. 2 is an exploded view of the cover, the throwing arm and the one-way bearing of the step auto clay thrower in accordance with the present invention (the clay not shown).
Figure 3:
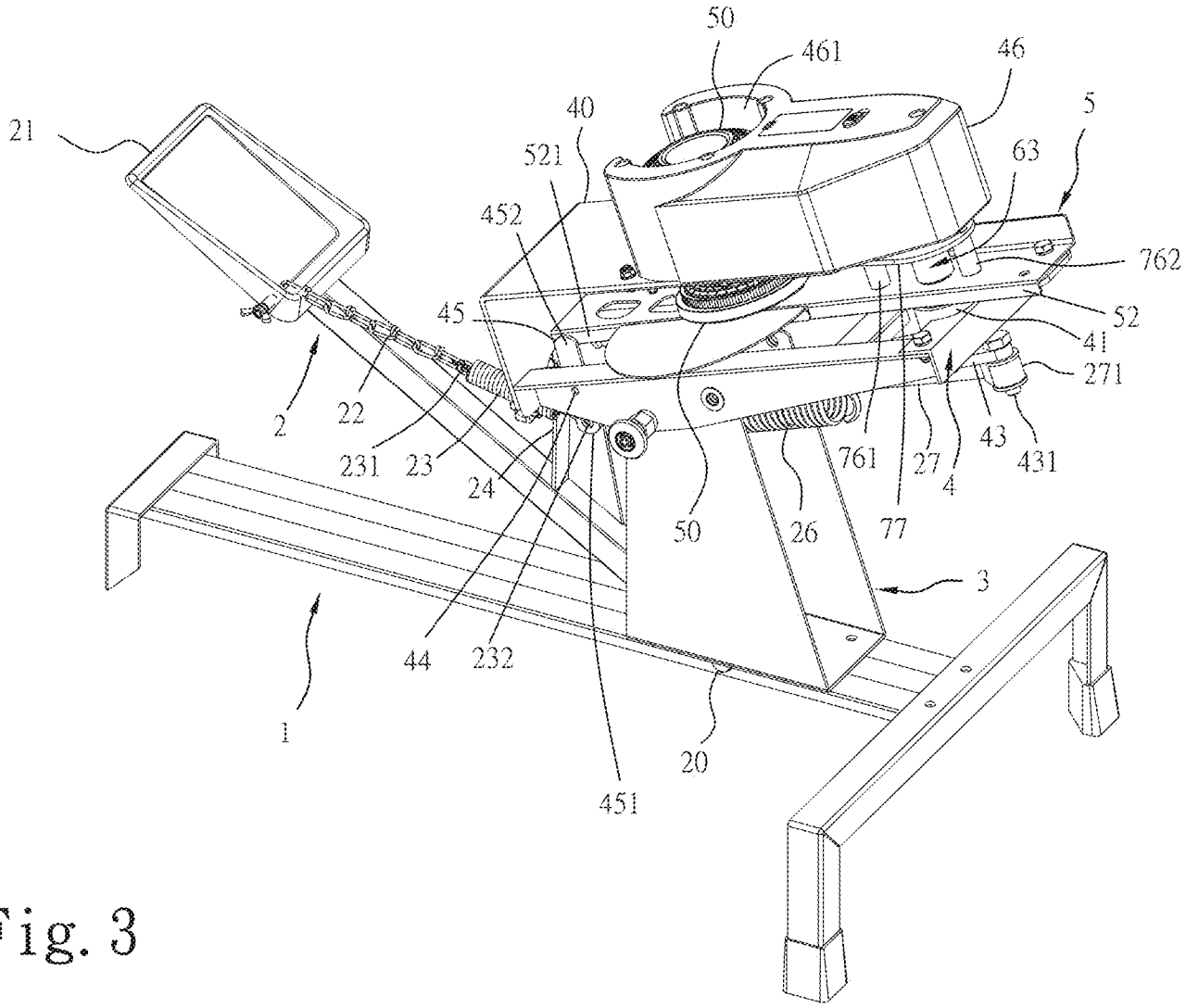
FIG. 3 is an elevational view of the present invention, illustrating a plurality of clays placed in the clay chamber.
Figure 4:
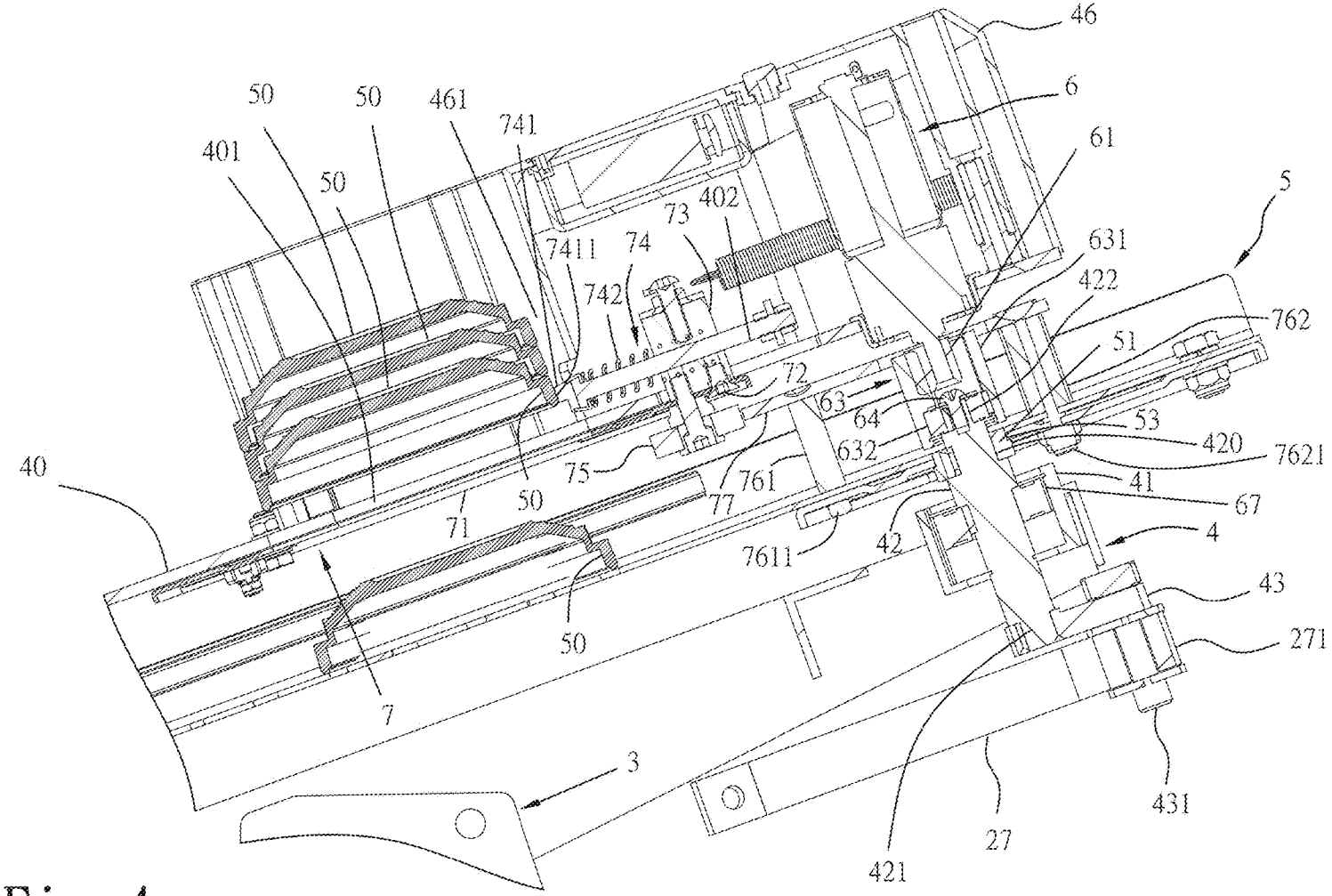
FIG. 4 is a sectional view, in an enlarged scale, of a part of FIG. 3.
Figure 5:
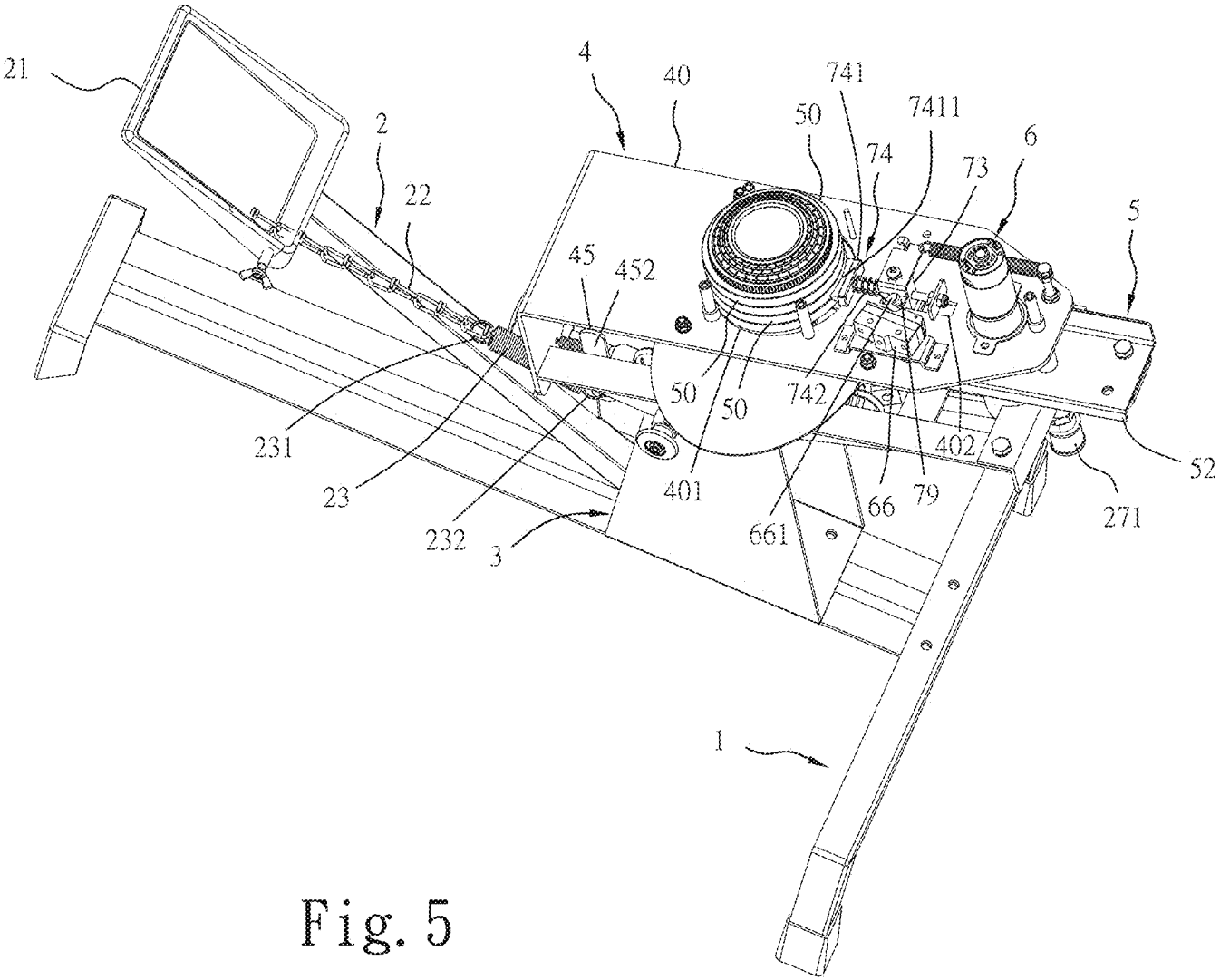
FIG. 5 is a schematic elevational view of the present invention, illustrating a plurality of clays placed in the clay chamber after removal of the cover.

Referring to FIGS. 1-12, a step auto clay thrower comprises:

a base 1;

a stepping rod 2 having a front end thereof pivotally connected to a front side of the base 1 by a first pivot member 20, an opposing rear end thereof connected with a pedal 21, the pedal 21 being connected to one end of a first connecting member 22 that has an opposite end thereof connected to one end 231 of a first spring 23, the stepping rod 2 having a front part thereof connected with a tilting bracket 24, the tilting bracket 24 being connected to one end 261 of a second spring 26 through a second connecting member 25, the second spring 26 having an opposite end 262 thereof connected to one end of a link 27;

a support 3 affixed to a front top side of the base 1;

a throwing arm holder 4 mounted on a top side of the support 3, comprising a first bearing block 41 located at a front side thereof (see FIGS. 1-4), a shaft 42 movably coupled to the first bearing block 41 (see FIG. 2 and FIG. 4) with a bottom end 421 thereof (see FIG. 4) connected with a first linking member 43 (see FIGS. 1-4), the first linking member 43 being pivotally connected to an opposite end 271 of the link 27 by a second pivot member 431, the throwing arm holder 4 having a back side thereof pivotally connected with a trigger arm 45 by a third pivot member 44 (see FIGS. 1-3), the trigger arm 45 having a bottom end 451 thereof connected to an opposite end 231 of the first spring 23;

a throwing arm 5 having a coupling groove 53 located on a front side thereof and connected with a third connecting member 51 (see FIG. 4) that is fixed connected with a top side 420 of the shaft 42 by welding (see FIG. 4), a rear top side thereof configured for the placement of a clay 50 (see FIG. 3), a rear side 521 of a sidewall 52 thereof (see FIGS., 2, 3 and 5) for stopping by a top side 452 of the trigger arm 45; and a mini motor 6 having a motor shaft 61 (see FIGS. 2 and 4) coupled with the shaft 42 for rotating the shaft 42 to return the throwing arm 5.

Thus, when the pedal 21 is depressed, the tilting bracket 24 extends the second spring 26, at the same time, the first connecting member 22 pulls the first spring 23 to bias the trigger arm 45. When the top side 452 of the trigger arm 45 is biased away from the rear side 521 of the sidewall 52 of the throwing arm 5, the elastic restoring energy of the second spring 26 drives the link 27 to move the first linking member 43, the shaft 42 and the throwing arm 5 to turn forward (see FIGS. 7-10). The centrifugal force thus generated force the throwing arm 5 to throw the clay 50 (see FIG. 7). Thereafter, the motor shaft 61 of the mini motor 6 rotates the shaft 42 (FIG. 11 illustrates the shaft 42 rotated through an angle but not reached the original position), thereby returning throwing arm 5 (see FIG. 12). When returned, the rear side 521 of the sidewall 52 of the throwing arm 5 is abutted against the top side 452 of the trigger arm 45 again.

Further, the motor shaft 61 of the mini motor 6 is connected with the top side 420 of the shaft 42 by a first one-way clutch 63 for rotating the shaft 42 in one direction to return the throwing arm 65. The first one-way clutch 63 comprises a second bearing block 631 and a first one-way bearing or a first ratchet 632. The motor shaft 61 of the mini motor 6 is connected to one side of the second bearing block 631 (see FIG. 4). An opposite side of the second bearing block 631 is connected to the first one-way bearing or first ratchet 632 (see FIG. 2 and FIG. 4). The first one-way bearing or first ratchet 632 is connected with a top end 422 of the shaft 42 by a fourth fastener 64 (see FIG. 4). The first bearing block 41 is connected with a second one-way clutch 67 and then movable connected to an opposing bottom end of the shaft 42 for enabling the shaft 42 to be rotated in one direction. The second one-way clutch 67 can be formed of a second one-way bearing or a second ratchet.

Further, the throwing arm holder 4 has an upper board 40 connected to and spaced above a top side thereof (see FIGS. 1-6). The upper board 40 has a first slot 401 (see FIG. 2 and FIG. 4) and is mounted with a cover 46 (see FIGS. 1-3). The cover 46 has a clay chamber 461 (see FIGS. 2 and 3) for holding clays 50 (see FIGS. 3 and 4). The clay chamber 461 has a bottom side configured to communicate with the first slot 401 (see FIG. 4). The upper board 40 has a sliding baffle 7 slidably coupled to a bottom side thereof (see FIG. 4, FIG. 6 and FIG. 10). The sliding baffle 7 has a clay slot 71 (see FIG. 6 and FIG. 10). The sliding baffle 7 is connected with an elastic clamping arm set 74 (see FIGS. 4, 5, 8 and 9) by at least one second fastener 72 (see FIG. 4) and at least one fourth connecting member 73 (see FIG. 4). The elastic clamping arm set 74 is disposed at the top side of the upper board 40 and movable forward and backward with the sliding baffle 7. The sliding baffle 7 has a front side thereof provided with a movable bearing member 75 (see FIGS. 4, 6 and 10). The bearing member 75 can be a movable bearing or wheel. The throwing arm 5 has a top side thereof mounted with a cam 77 by fifth connecting members 761;762 (see FIG. 2 and FIG. 4) and third fasteners 7611;7621 (see FIG. 4) for abutting and moving the bearing member 75 of the sliding baffle 7 (see FIG. 6 and FIG. 10).

The upper board 40 further has a second slot 402 (see FIGS. 4 and 5) for allowing the fourth connecting member 73 of the sliding baffle 7 (see FIG. 4) to be moved forward and backward relative to the upper board 40. The elastic clamping arm set 74 comprises a clamping arm 741. The clamping arm 741 has one end 7411 thereof (see FIG. 4 and FIG. 8) configured for abutting at one side of the clay 50 (see FIGS. 4 and 5), and an opposite end thereof mounted with a third spring 742 (see FIGS. 4 and 5) and fixed connected with a fourth connecting member 73 (see FIG. 4). Thus, when the throwing arm 5 is turned forward to throw the clay 50, the throwing arm 5 is abutted against the bearing member 75 of the sliding baffle 7 through the cam 77 to move the sliding baffle 7 forward, making the clay slot 71 not in complete communication with the first slot 401 of the upper board 40 and causing a stop portion 78 of the sliding baffle 7 to block the first slot 401 (see FIG. 10). At the same time, the elastic clamping arm set 74 is moved forward with the sliding baffle 7 without clamping the clay 50 (see FIG. 10), enabling the clay 50 in the clay chamber 461 to be lowered and stopped by the stop portion 78 of the sliding baffle 7 (see FIG. 8). Further, when the mini motor 6 returns the throwing arm 5, the throwing arm 5 is abutted against the bearing member 75 of the sliding baffle 7 through the cam 77 to move the sliding baffle 7 backward, enabling the clay slot 71 to be in complete communication with the first slot 401 of the upper board 40 (see FIG. 4), and thus, the bottom-sided clap 50 falls out of the clay chamber 461 to the rear top side of the throwing arm 5 (see FIG. 4) and the elastic clamping arm set 74 moves synchronously backward with the sliding baffle 7 to clamp the bottom-sided clay 50 in the clay chamber 461 (see FIG. 4), prohibiting the clamped clay 50 and the other clays 50 from falling down. Further, the mini motor 6 is electrically connected to a micro switch 66 (see FIG. 5 and FIG. 9). The micro switch 66 is mounted on the upper board 40, having a contact portion 661 (see FIG. 5 and FIG. 9). The fourth connecting member 73 of the elastic clamping arm set 74 is connected with an abutment member 79 that is moved to contact the contact portion 661 of the micro switch 66 (see FIG. 5) or apart from the contact portion 661 of the micro switch 66 (see FIG. 9). Before turning the throwing arm 5 forward, the contact portion 661 of the micro switch 66 is abutted against the abutment member 79. When the throwing arm 5 is turned forward to throw the clay 50 (see FIG. 9), the elastic clamping arm set 74 is moved forward with the sliding baffle 7 to carry the abutment member 79 away from the contact portion 661 of the micro switch (see FIG. 9). Through the micro switch 66 to turn on the mini motor 6, the throwing arm 5 is turned back to its original position (see FIG. 12).

Figure 6:
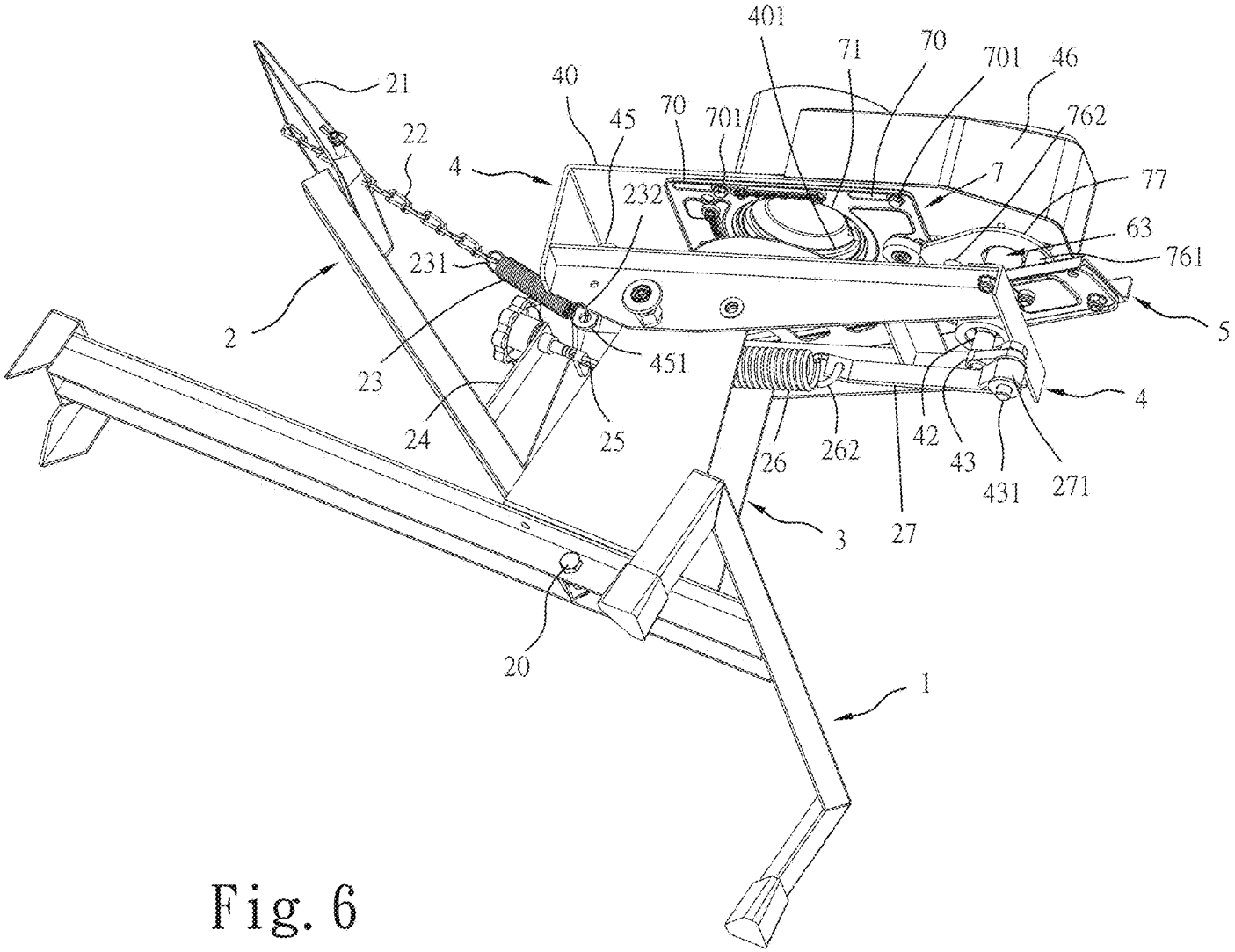
FIG. 6 is another elevational view of the present invention when viewed from another angle (clay not shown).
Figure 7:
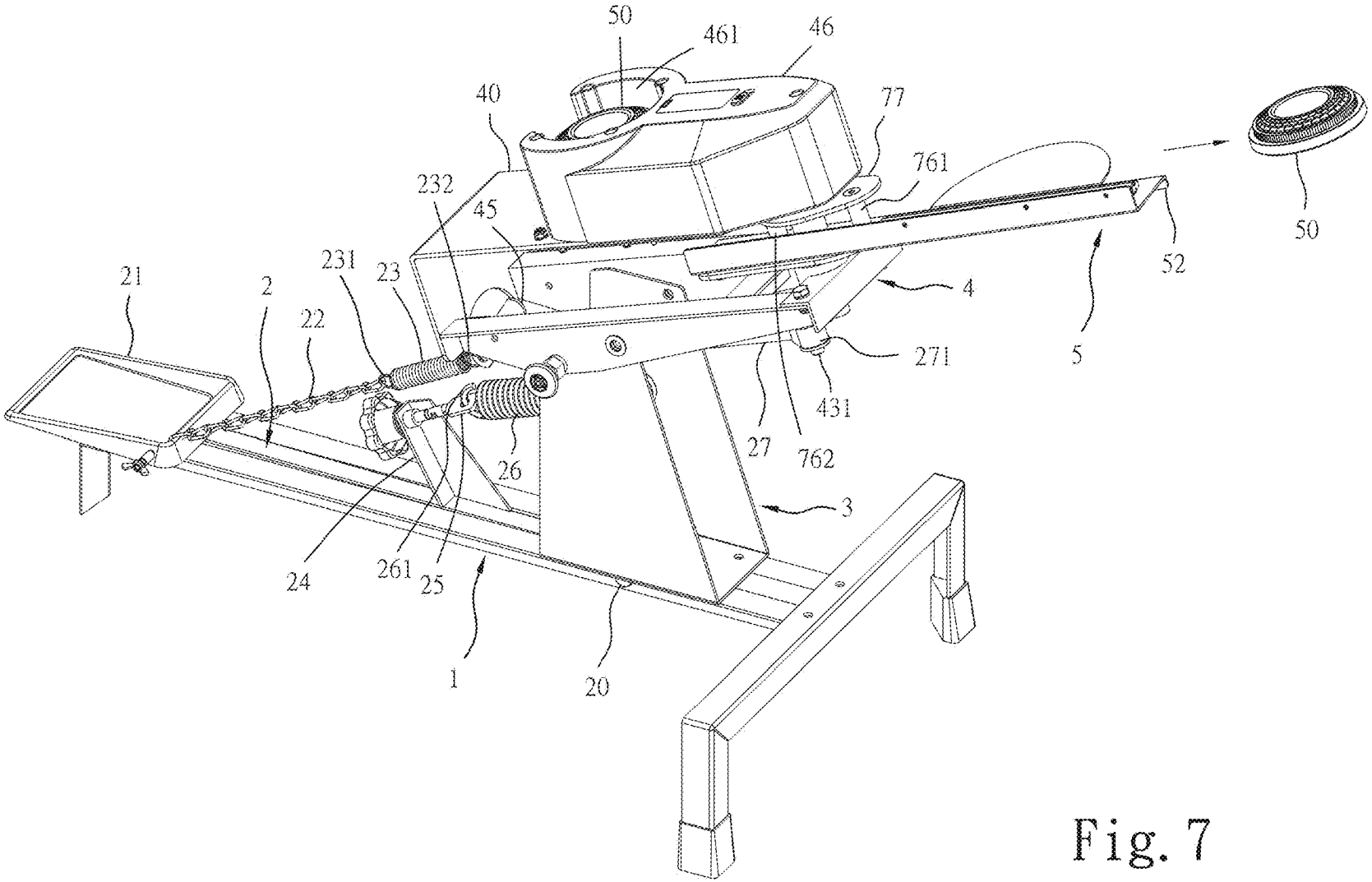
FIG. 7 is a schematic elevational view of the present invention, illustrating the pedal depressed, the throwing arm throwed the clay.
Figure 8:
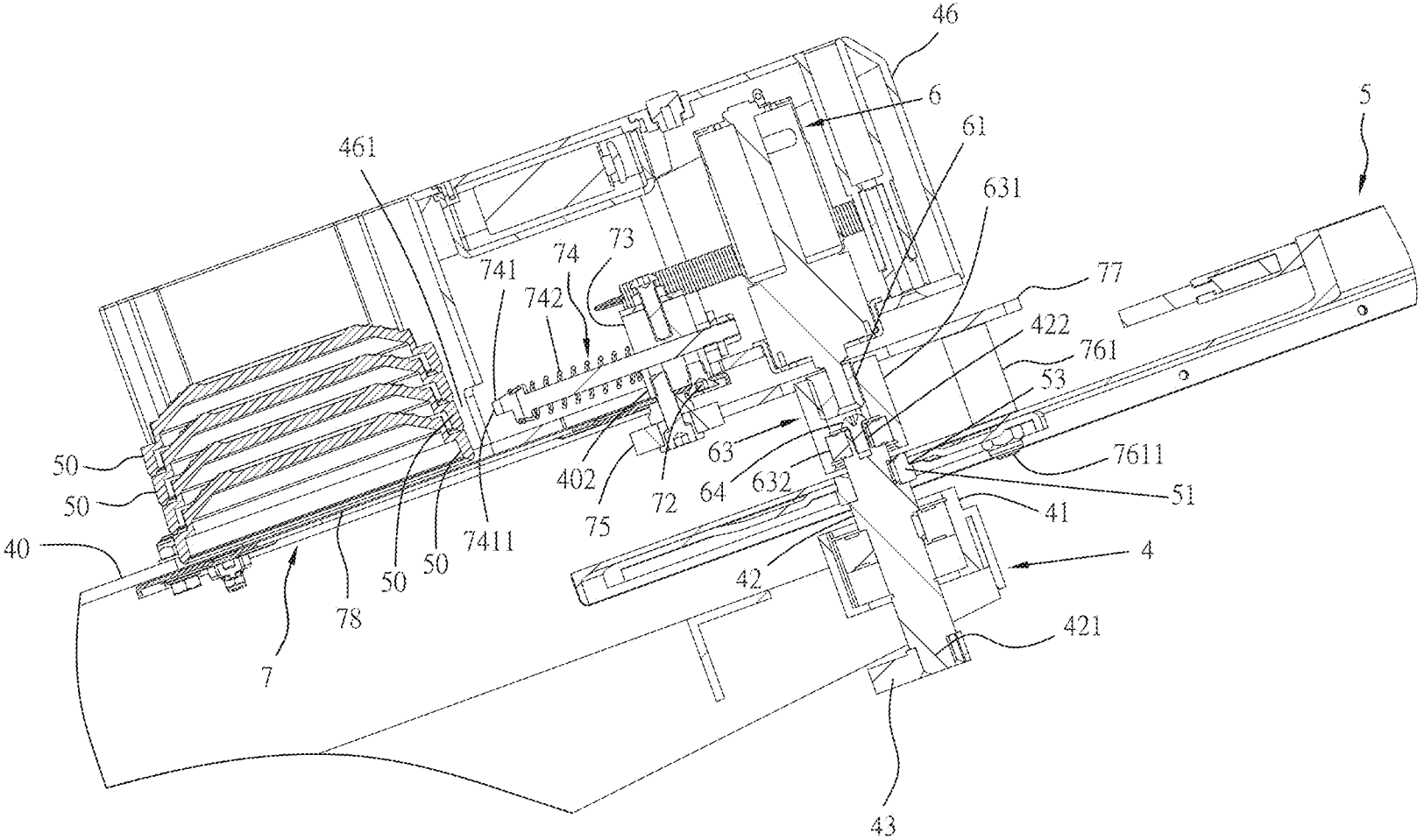
FIG. 8 is a sectional view, in an enlarged scale of a part of FIG. 7.
Figure 9:
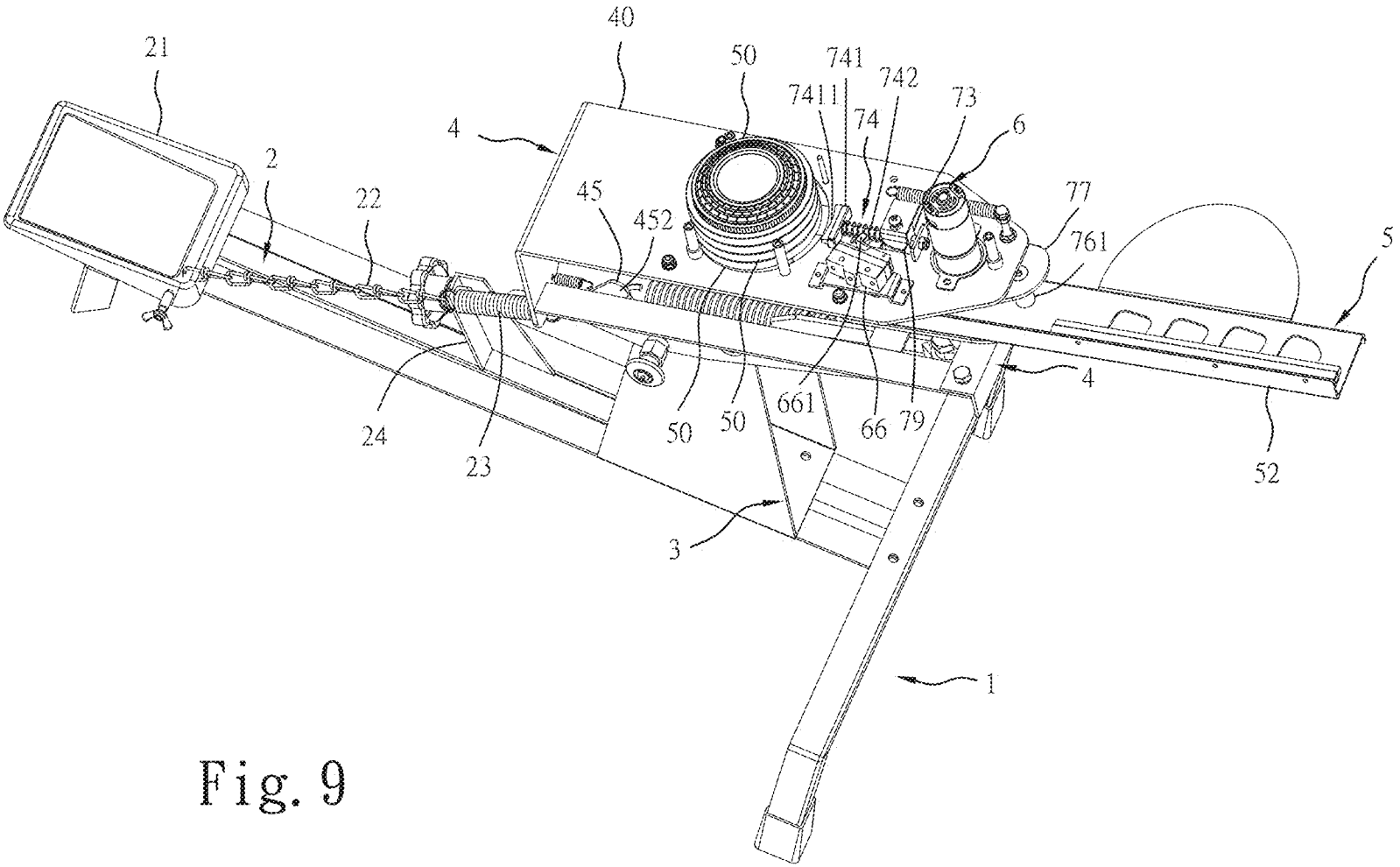
FIG. 9 is a schematic elevational view of the present invention, illustrating the pedal depressed, the throwing arm throwed the clay after removal of the cover.
Figure 10:
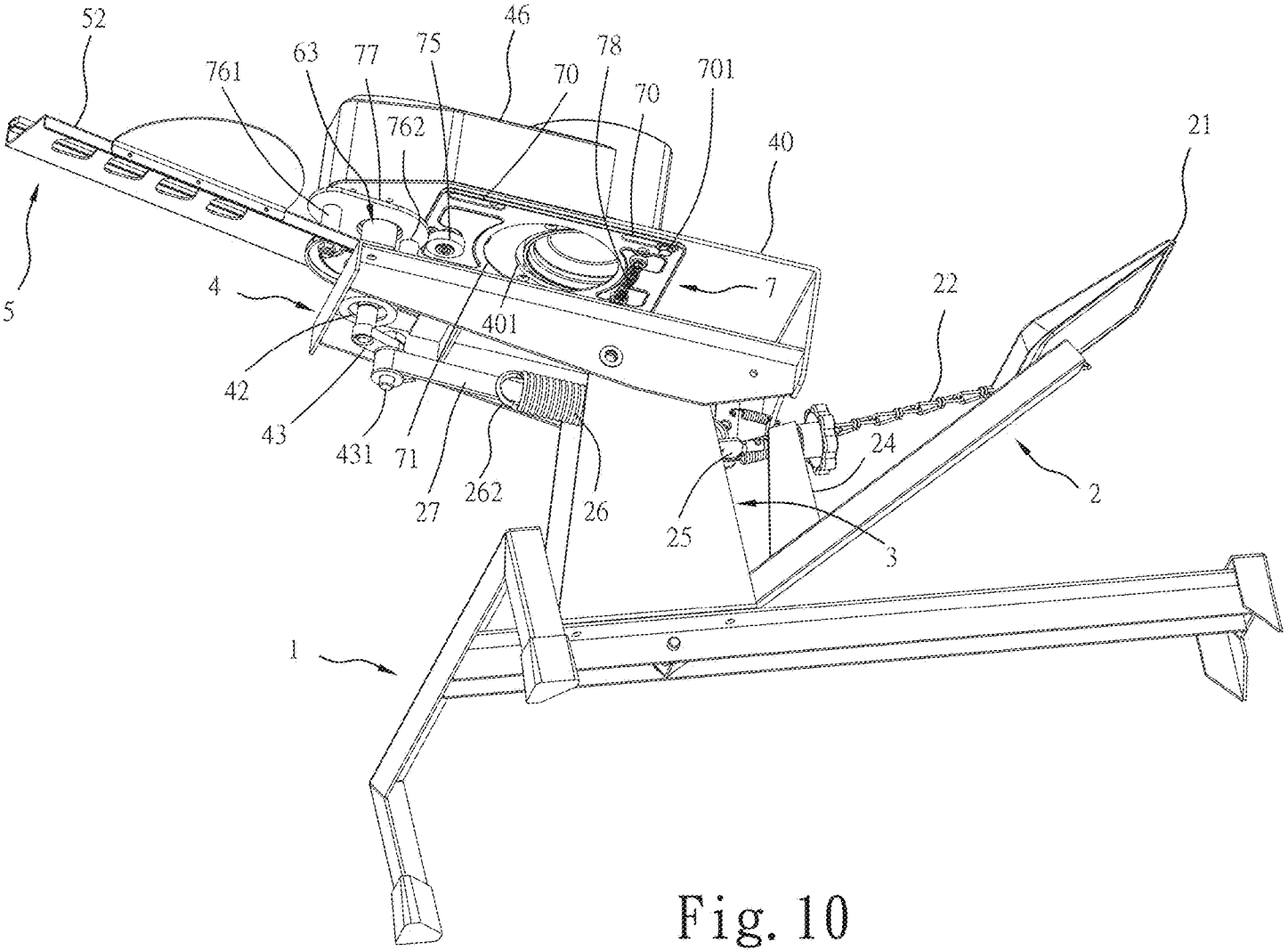
FIG. 10 corresponds to FIG. 9 when viewed from another angle.
Figure 11:
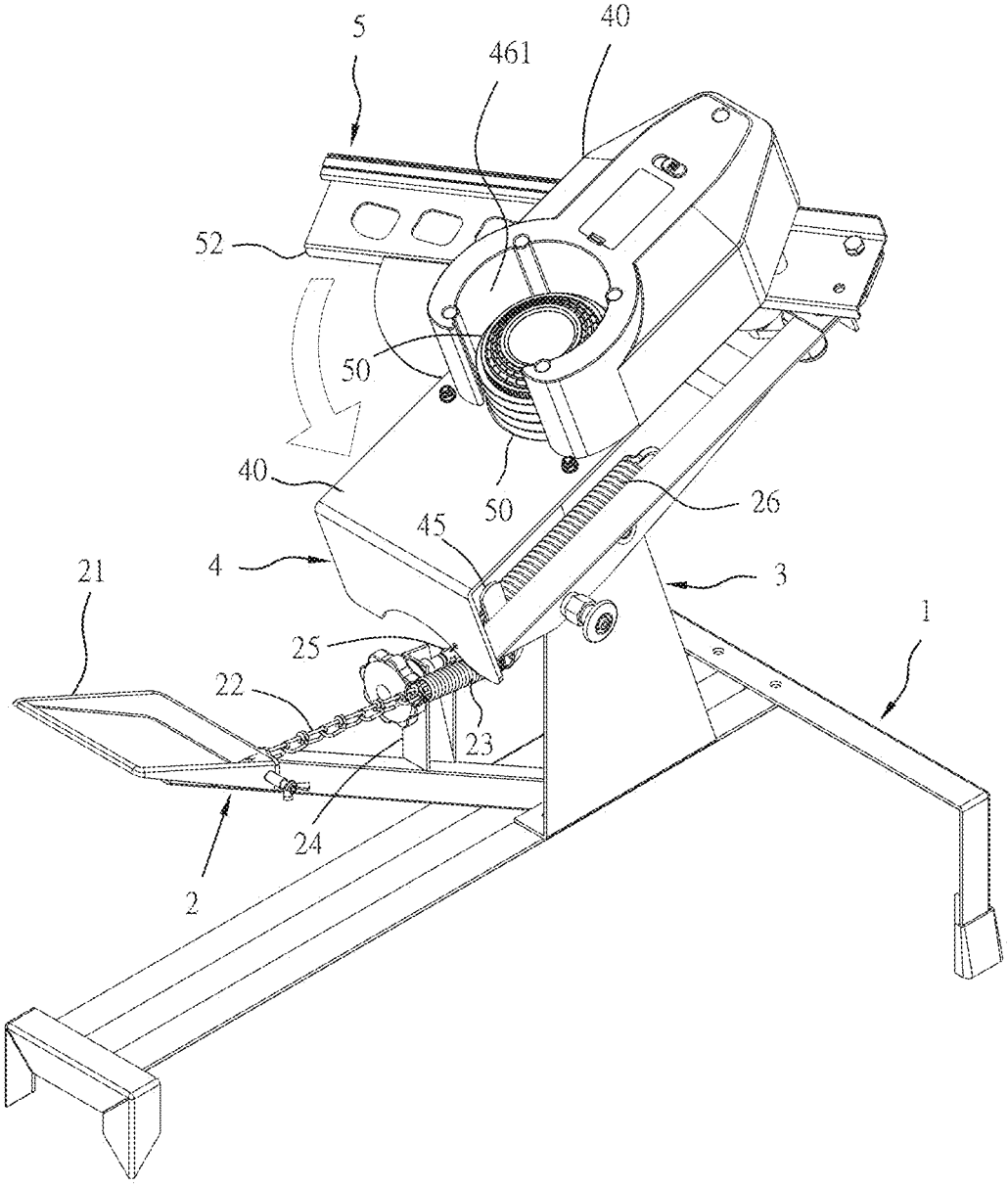
FIG. 11 is an elevational view of the present invention, showing the pedal depressed, the throwing arm throwed the clay, the mini motor actuated, the throwing arm turned through an angle.
Figure 12:
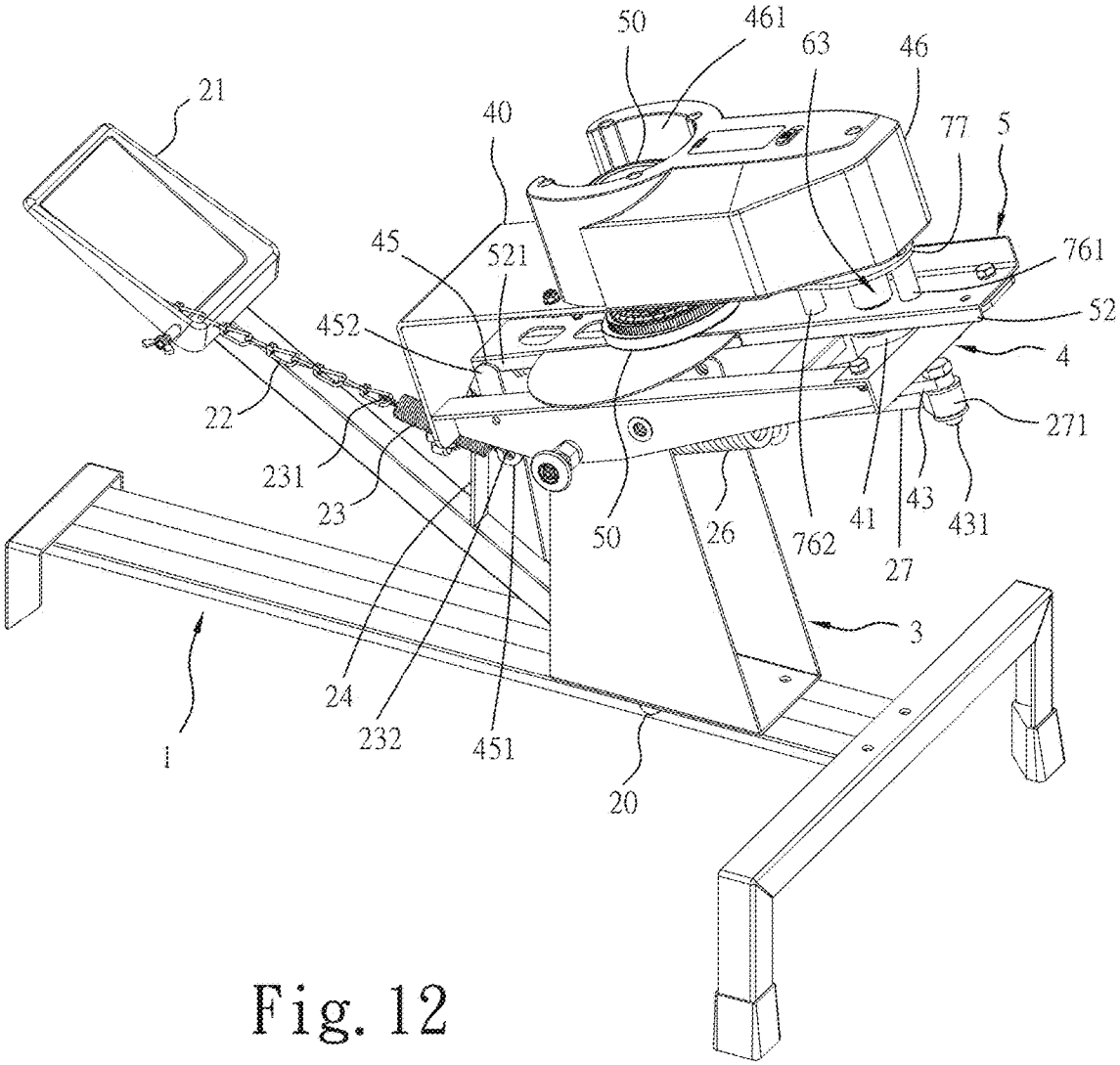
FIG. 12 corresponds to FIG. 11, showing the throwing arm returned.

Further, the sliding baffle 7 has a sliding slot 70 located on each of two opposite sides thereof (see FIG. 6 and FIG. 10). Two guide pins 701 are respectively inserted through the sliding slots 70 and affixed to the upper board 40 (see FIG. 6 and FIG. 10) to guide the sliding baffle 7 to slide forward and backward relative to the upper board 40.

In conclusion, the invention has the advantages as follows:

1. Ease of operation. When the throwing arm 5 throws the clay 50, the mini motor 6 is automatically started to return the throwing arm 5.

2. When the throwing arm 5 is driven to return to its original position by the mini motor 6, the cam 77 moves the sliding baffle 7, enabling the lowest clay 50 to fall out of the clay chamber 461 onto the throwing arm 5, thus, there is no need to manually load the clay, facilitating operation. In the period after the throwing arm 5 throwed the clay 50 and before the throwing arm 5 is returned by the mini motor 6, the rotation of the mini motor 6 does not need to bear the force of the second spring 26 (i.e., the operation of the mini motor 6 to turn the throwing arm 5 does not need to overcome the force of the second spring 26), so that the use of a small size of mini motor 6 is sufficient.

What is claimed is:

1. A step auto clay thrower, comprising:

a base;

a stepping rod having a front end thereof pivotally connected to a front side of said base by a first pivot member, an opposing rear end thereof connected with a pedal, said pedal being connected to one end of a first connecting member that has an opposite end thereof connected to one end of a first spring, said stepping rod having a front part thereof connected with a tilting bracket, said tilting bracket being connected to one end of a second spring through a second connecting member, said second spring having an opposite end thereof connected to one end of a link;

a support affixed to a front top side of said base;

a throwing arm holder mounted on a top side of said support, said throwing arm holder comprising a first bearing block located at a front side thereof, a shaft movably coupled to said first bearing block with a bottom end thereof connected with a first linking member, said first linking member being pivotally connected to an opposite end of said link by a second pivot member, said throwing arm holder having a back side thereof pivotally connected with a trigger arm by a third pivot member, said trigger arm having a bottom end thereof connected to an opposite end of said first spring;

a throwing arm having a coupling groove located on a front side thereof and connected with a third connecting member that is fixed connected with a top side of said shaft by welding, a rear top side configured for the placement of a clay, a rear side of a sidewall thereof for stopping by a top side of the trigger arm; and a mini motor having a motor shaft coupled with said shaft for rotating said shaft to return said throwing arm.

2. The step auto clay thrower as claimed in claim 1, wherein said motor shaft of said mini motor 6 is connected with said top side of said shaft by a first one-way clutch for rotating said shaft in one direction to return said throwing arm.

3. The step auto clay thrower as claimed in claim 2, wherein said first one-way clutch comprises a second bearing block and a first one-way bearing (or first ratchet), said second bearing block having one side thereof connected to said motor shaft of said mini motor and an opposite side thereof connected to said first one-way bearing (or first ratchet), said first one-way bearing (or first ratchet) being fixedly connected to a top end of said shaft by a fourth fastener.

4. The step auto clay thrower as claimed in claim 1, wherein said first bearing block is mounted with a second one-way clutch and then movable connected to a bottom end of said shaft for enabling said shaft to be rotated in one direction.

5. The step auto clay thrower as claimed in claim 1, wherein said second one-way clutch is selectively formed of a second one-way bearing or a second ratchet.

6. The step auto clay thrower as claimed in claim 1, wherein said throwing arm holder has an upper board connected to and spaced above a top side thereof, said upper board having a first slot 401 and being mounted with a cover, said cover comprising a clay chamber 461 for holding clays, said clay chamber having a bottom side configured to communicate with said first slot, said upper board having a sliding baffle slidably coupled to a bottom side thereof, said sliding baffle having a clay slot, said sliding baffle being connected with an elastic clamping arm set by at least one second fastener and at least one fourth connecting member, said elastic clamping arm set being disposed at an opposing top side of said upper board and movable forward and backward with said sliding baffle, said sliding baffle having a front side thereof provided with a movable bearing member, said bearing member having a top side thereof mounted with a cam by fifth connecting members and third fasteners for abutting and moving said bearing member of said sliding baffle, said upper board further having a second slot for allowing said fourth connecting member of said sliding baffle to be moved forward and backward relative to said upper board, said elastic clamping arm set comprising a clamping arm, said clamping arm having one end thereof configured for abutting at one side of a clay and an opposite end thereof mounted with a third spring and fixed connected with a fourth connecting member, said mini motor being electrically connected to a micro switch, said micro switch being mounted on said upper board and having a contact portion1, said fourth connecting member of said elastic clamping arm set being connected with an abutment member that is movable to contact said contact portion of said micro switch or apart from said contact portion of said micro switch, said contact portion of said micro switch being abutted against said abutment member before said throwing arm is turned forward, said elastic clamping arm set being moved forward with said sliding baffle to carry said abutment member away from said contact portion of said micro switch when said throwing arm is turned forward to throw the clay so that said throwing arm is turned back by means of the triggering of said micro switch to turn on said mini motor.

7. The step auto clay thrower as claimed in claim 6, wherein said bearing member is selectively a movable axle bearing or wheel.

* * * * *